US011674734B2

(12) United States Patent
Evans

(10) Patent No.: US 11,674,734 B2
(45) Date of Patent: Jun. 13, 2023

(54) THERMAL MASS FOR PRESERVING FOOD IN FUNCTIONAL COMPARTMENTS

(71) Applicant: Electrolux Home Products, Inc., Charlotte, NC (US)

(72) Inventor: Gregory H. Evans, Concord, NC (US)

(73) Assignee: Electrolux Home Products, Inc., Charlotte, NC (US)

( * ) Notice: Subject to any disclaimer, the term of this patent is extended or adjusted under 35 U.S.C. 154(b) by 414 days.

(21) Appl. No.: 16/852,771

(22) Filed: Apr. 20, 2020

(65) Prior Publication Data

US 2021/0325102 A1 Oct. 21, 2021

(51) Int. Cl.

| | |
|---|---|
| ***F25D 23/12*** | (2006.01) |
| ***F25D 17/06*** | (2006.01) |
| ***F25D 25/02*** | (2006.01) |

(52) U.S. Cl.

CPC ..... *F25D 17/065* (2013.01); *F25D 23/12* (2013.01); *F25D 25/025* (2013.01); *F25D 2317/061* (2013.01); *F25D 2600/04* (2013.01)

(58) Field of Classification Search

CPC ..... F25D 11/006; F25D 3/00

See application file for complete search history.

(56) References Cited

U.S. PATENT DOCUMENTS 5,605,047 A * 2/1997 Park ..... F25D 23/003 62/3.6
5,918,480 A 7/1999 Nagata et al.
6,282,914 B1 * 9/2001 Steinhoff ..... F25D 23/10 62/258
6,401,461 B1 * 6/2002 Harrison ..... F25B 21/02 62/3.61
6,817,208 B2 11/2004 Choi et al.
7,043,935 B2 5/2006 Hunter
7,051,549 B2 5/2006 Kim et al.
7,062,928 B2 6/2006 Karlsson et al.
7,213,408 B2 * 5/2007 Zhao ..... F25D 11/006 62/419
7,347,060 B2 3/2008 Krempel
7,757,511 B2 * 7/2010 LeClear ..... F25C 1/04 62/340
8,028,538 B2 10/2011 Kim et al.
8,449,050 B2 * 5/2013 Karg ..... A47B 88/463 312/223.6
9,182,168 B2 * 11/2015 Hernandez ..... F25D 25/025

(Continued)

FOREIGN PATENT DOCUMENTS

CN 1727826 A * 2/2006 ..... F25D 23/021
JP 08247612 A 9/1996

*Primary Examiner* — Filip Zec

(74) *Attorney, Agent, or Firm* — Pearne & Gordon LLP

(57) ABSTRACT

A refrigerator includes a temperature-controlled drawer within a fresh food compartment. The drawer includes a temperature dampening member in thermal communication with a freezing air source and an interior or the drawer. The member is made of a thermally conductive material. In use, heat is conducted away from the interior of the drawer through the temperature dampening member in communication with the freezing air source. Thus, freezing of a foodstuff within the drawer is minimized or prevented, a temperature variance within the drawer is minimized, and humidity within the drawer is not adversely affected by dry freezing air source.

12 Claims, 3 Drawing Sheets

(56) References Cited

U.S. PATENT DOCUMENTS

| | | | | |
|---|---|---|---|---|
| 9,625,202 | B2 * | 4/2017 | Lopes | F25C 5/22 |
| 10,371,433 | B2 | 8/2019 | Lee et al. | |
| 2007/0163291 | A1 * | 7/2007 | Kim | F25D 17/08 62/408 |
| 2011/0259035 | A1 * | 10/2011 | Wang | F25D 23/04 62/340 |
| 2014/0028172 | A1 | 1/2014 | Min et al. | |
| 2015/0159924 | A1 * | 6/2015 | Calderon | F25D 11/006 62/3.6 |
| 2018/0209713 | A1 | 7/2018 | Yun et al. | |

* cited by examiner

THERMAL MASS FOR PRESERVING FOOD IN FUNCTIONAL COMPARTMENTS

FIELD OF THE INVENTION

This invention is related to a refrigerator with drawer having a heat conductor in direct communication with a source of freezing air.

BACKGROUND OF THE INVENTION

Conventional refrigeration appliances, such as domestic refrigerators, typically have both a fresh food compartment and a freezer compartment or section. The fresh food compartment is where food items such as fruits, vegetables, and beverages are stored. The freezer compartment is where food items that are to be kept in a frozen condition are stored. The refrigerators are provided with refrigeration systems that maintains the fresh food compartment at temperatures above 0° C., such as between 0.25° C. and 4.5° C. and the freezer compartments at temperatures below 0° C., such as between 0° C. and −20° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment can be accessed without exposing the other compartment to the ambient air.

Many refrigerators include drawers (or other sub-compartments) in the fresh food compartment. These drawers may be used to provide an environment different form the rest of the fresh food compartment, for example a different temperature and/or humidity. To minimize or reduce cost associated with providing that different environment, there is a need for a new mechanism (or method) for providing that different environment.

SUMMARY OF THE INVENTION

A refrigerator includes a temperature-controlled drawer within a fresh food compartment. The drawer includes a temperature dampening member in thermal communication with a freezing air source and an interior or the drawer. The member is made of a thermally conductive material. In use, heat is conducted away from the interior of the drawer through the temperature dampening member in communication with the freezing air source. Thus, freezing of a foodstuff within the drawer is minimized or prevented, a temperature variance within the drawer is minimized, and humidity within the drawer is not adversely affected by dry freezing air source.

DESCRIPTION OF THE DRAWINGS

For the purpose of illustrating the invention, there is shown in the drawings a form that is presently preferred; it being understood, however, that this invention is not limited to the precise arrangements and instrumentalities shown.

DESCRIPTION OF THE INVENTION

Figure 1:
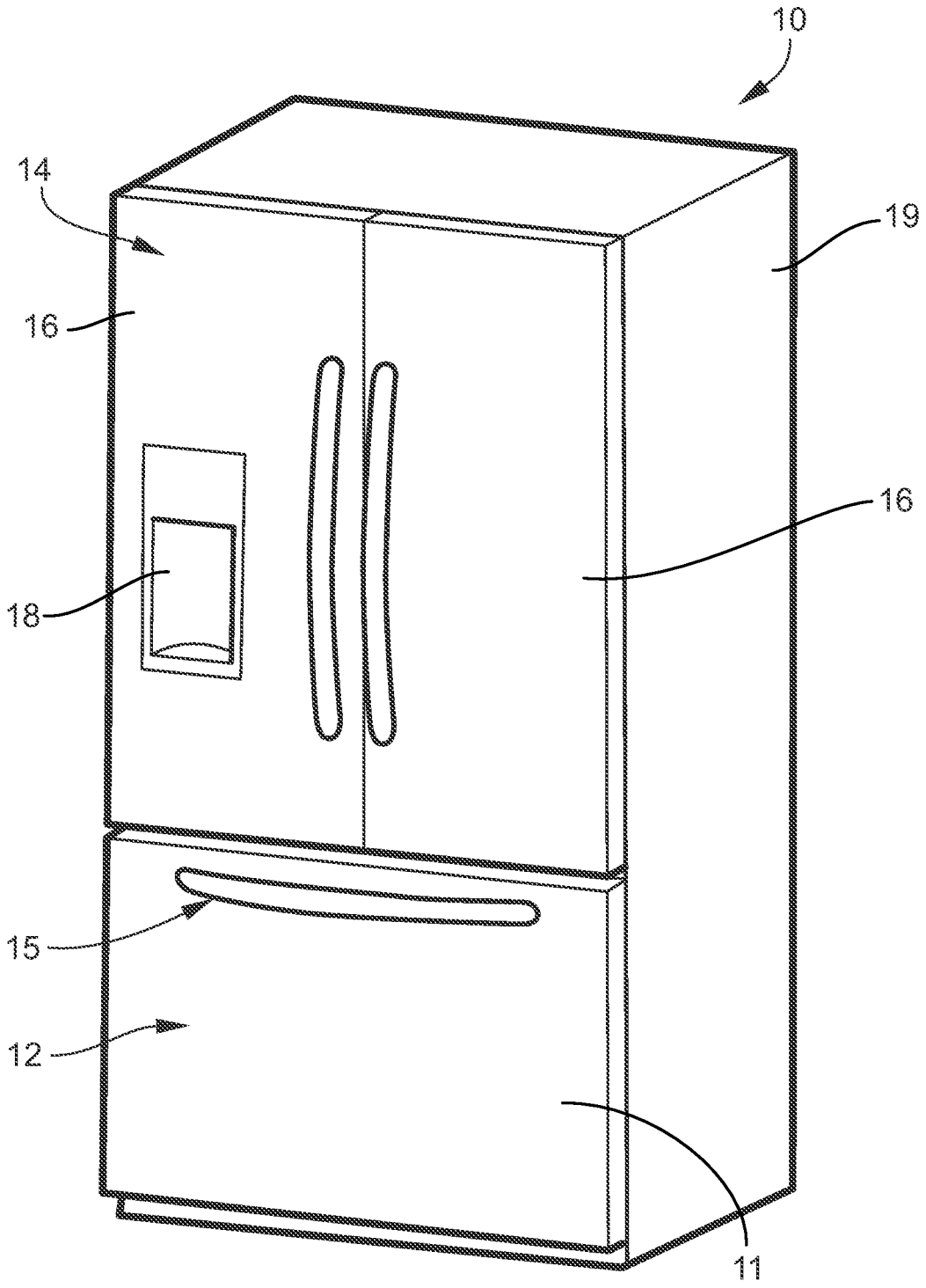
FIG. 1 is a front perspective view of a prior art household French door bottom mount refrigeration appliance showing doors of the fresh food compartment and drawer of a freezer compartment in a closed position.
Figure 2:
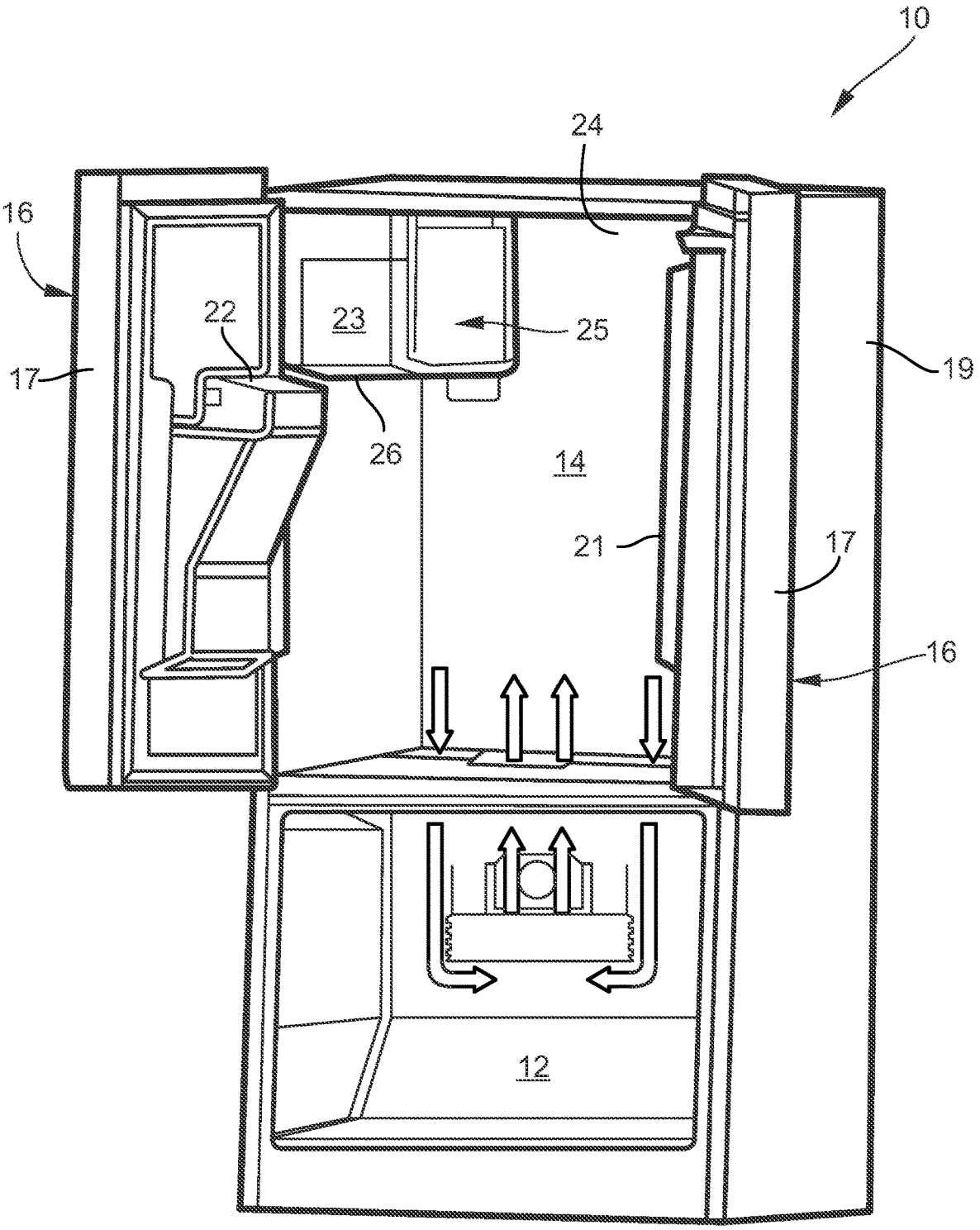
FIG. 2 is a front perspective view of the prior art refrigeration appliance of FIG. 1 showing the doors of the fresh food compartment in opened positions and the drawer of the freezer compartment removed.

Referring now to the drawings, FIGS. 1 and 2 show a refrigeration appliance in the form of a domestic refrigerator, indicated generally at 10. Although the detailed description that follows concerns a domestic refrigerator 10, the invention can be embodied by refrigeration appliances other than a domestic refrigerator 10. An embodiment is described in detail below, and shown in the figures as a bottom-mount configuration of a refrigerator 10, including a fresh food compartment 14 disposed vertically above a freezer compartment 12. However, the refrigerator 10 can have any desired configuration including at least a fresh food compartment 14 and/or a freezer compartment 12, such as a top mount refrigerator (freezer disposed above the fresh food compartment), a side-by-side refrigerator (fresh food compartment is laterally next to the freezer compartment), a standalone refrigerator or freezer, etc.

One or more doors 16 shown in FIG. 1 are pivotably coupled to a cabinet 19 of the refrigerator 10 to restrict and grant access to the fresh food compartment 14. The door 16 can include a single door that spans the entire lateral distance across the entrance to the fresh food compartment 14, or can include a pair of French-type doors 16 as shown in FIG. 1 that collectively span the entire lateral distance of the entrance to the fresh food compartment 14 to enclose the fresh food compartment 14.

For the latter configuration, a center flip mullion 21 (FIG. 2) is pivotally coupled to at least one of the doors 16 to establish a surface against which a seal provided to the other one of the doors 16 can seal the entrance to the fresh food compartment 14 at a location between opposing side surfaces 17 (FIG. 2) of the doors 16. The mullion 21 can be pivotably coupled to the door 16 to pivot between a first orientation that is substantially parallel to a planar surface of the door 16 when the door 16 is closed, and a different orientation when the door 16 is opened. The externally exposed surface of the center mullion 21 is substantially parallel to the door 16 when the center mullion 21 is in the first orientation and forms an angle other than parallel relative to the door 16 when the center mullion 21 is in the second orientation. The seal and the externally exposed surface of the mullion 21 cooperate approximately midway between the lateral sides of the fresh food compartment 14.

A dispenser 18 (FIG. 1) for dispensing at least ice pieces, and optionally water, can be provided on an exterior of one of the doors 16 that restricts access to the fresh food compartment 14. The dispenser 18 includes an actuator (e.g., lever, switch, proximity sensor, etc.) to cause ice pieces to be dispensed from an ice bin 23 (FIG. 2) of an ice maker 25 disposed within the fresh food compartment 14. Ice pieces from the ice bin 23 can exit the ice bin 23 through an aperture 26 and be delivered to the dispenser 18 via an ice chute 22 (FIG. 2), which extends at least partially through the door 16 between the dispenser 18 and the ice bin 23.

The freezer compartment 12 is arranged vertically beneath the fresh food compartment 14. A drawer assembly (not shown) including one or more freezer baskets (not shown) can be withdrawn from the freezer compartment 12 to grant a user access to food items stored in the freezer compartment 12. The drawer assembly can be coupled to a freezer door 11 that includes a handle 15. When a user grasps the handle 15 and pulls the freezer door 11 open, at least one or more of the freezer baskets is caused to be at least partially withdrawn from the freezer compartment 12.

In alternative embodiments, the ice maker is located within the freezer compartment. In this configuration, although still disposed within the freezer compartment, at least the ice maker (and possible an ice bin) is mounted to an interior surface of the freezer door. It is contemplated that the ice mold and ice bin can be separate elements, in which one remains within the freezer compartment and the other is on the freezer door.

The freezer compartment 12 is used to freeze and/or maintain articles of food stored in the freezer compartment 12 in a frozen condition. For this purpose, the freezer compartment 12 is in thermal communication with a freezer evaporator (not shown) that removes thermal energy from the freezer compartment 12 to maintain the temperature therein at a temperature of 0° C. or less during operation of the refrigerator 10, preferably between 0° C. and −50° C., more preferably between 0° C. and −30° C. and even more preferably between 0° C. and −20° C.

The refrigerator 10 includes an interior liner 24 (FIG. 2) that defines the fresh food compartment 14. The fresh food compartment 14 is in the upper portion of the refrigerator 10 in this example and serves to minimize spoiling of articles of food stored therein. The fresh food compartment 14 accomplishes this aim by maintaining the temperature in the fresh food compartment 14 at a cool temperature that is typically above 0° C., so as not to freeze the articles of food in the fresh food compartment 14. It is contemplated that the cool temperature preferably is between 0° C. and 10° C., more preferably between 0° C. and 5° C. and even more preferably between 0.25° C. and 4.5° C.

According to some embodiments, cool air from which thermal energy has been removed by the freezer evaporator can also be blown into the fresh food compartment 14 to maintain the temperature therein greater than 0° C. preferably between 0° C. and 10° C., more preferably between 0° C. and 5° C. and even more preferably between 0.25° C. and 4.5° C. For alternate embodiments, a separate fresh food evaporator can optionally be dedicated to separately maintaining the temperature within the fresh food compartment 14 independent of the freezer compartment 12.

According to an embodiment, the temperature in the fresh food compartment 14 can be maintained at a cool temperature within a close tolerance of a range between 0° C. and 4.5° C., including any subranges and any individual temperatures falling with that range. For example, other embodiments can optionally maintain the cool temperature within the fresh food compartment 14 within a reasonably close tolerance of a temperature between 0.25° C. and 4° C.

Figure 3:
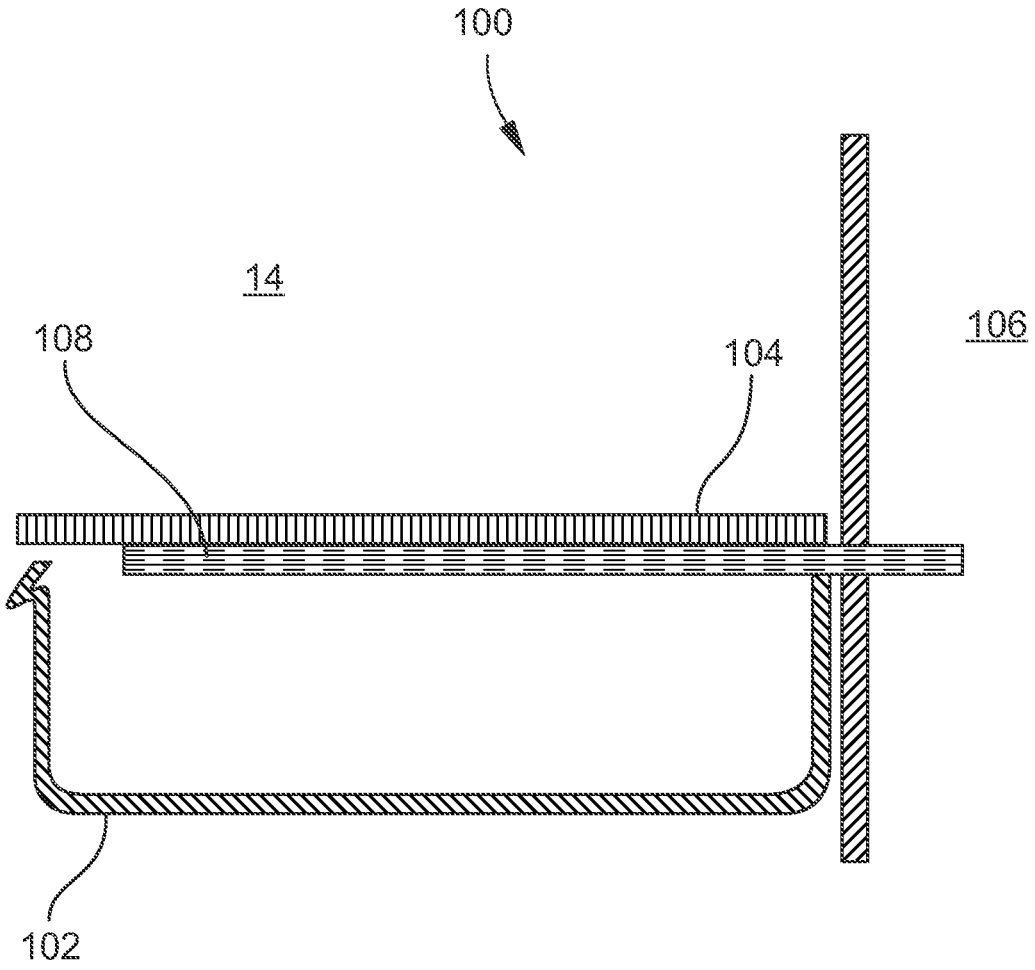
FIG. 3 is a schematic illustration of the inventive drawer.

Referring to FIG. 3, an inventive embodiment 100 is illustrated. In general, the refrigerator 10 with the fresh food compartment 14 and at least one drawer 102 within fresh food compartment 14. Drawer 102 is slidably mounted below a shelf 104. Freezing air, from the freezer evaporator, is delivered into the fresh food compartment via a plenum 106. Plenum 106 may be adjacent drawer 104, but is not so limited. A temperature dampening member 108 is in direct communication between the freezing air source and the interior of the drawer 102. As shown in FIG. 3, one end of member 108 is within or adjacent or in proximity of the drawer 102, and the other end of member 108 is within or direct communication with the freezing air source, for example within plenum 106. With this configuration of member 108, heat is conducted away from the interior of the drawer through the member 108 that is in communication with the freezing air source. By so doing, freezing of a foodstuff within the drawer is minimized or prevented, a temperature variance within the drawer is minimized, and humidity within the drawer is not adversely affected by dry freezing air source.

Member 108 is made of a heat conducting material or heat conducting metal. Such heat conducting materials may have, in some embodiments, a thermal conductivity of at least about 40 watts/meter-C°, and in other embodiments, a thermal conductivity of at least about 100 watts/meter-C°, and in still other embodiments, a thermal conductivity in a range of about 40-600 watts/meter-C°. Such materials include, but not limited to, aluminum, copper, steel, nickel, combinations thereof and alloys thereof.

Member 108 is illustrated, in FIG. 3, as a planar member, but may include fins (not shown) at either end to facilitate thermal conductions. Member 108 may be a made entirely of the heat conducting material (i.e. a solid heat conduction material) or may be made of partially of the heat conducting material (e.g., strips of the heat conducting material, extending from end to end, within a matrix of less conductive (or less expensive material, e.g., synthetic plastic material) where a surface of the strip is exposed on the surface of the matrix).

The present invention may be embodied in other forms without departing from the spirit and the essential attributes thereof, and, accordingly, reference should be made to the appended claims, rather than to the foregoing specification, as indicating the scope of the invention.

I claim:

1. A refrigerator comprises:

a temperature-controlled drawer within a fresh food compartment including:

a temperature dampening member in thermal communication with a freezing air source and an interior of the drawer and is made of a thermally conductive material, wherein the freezing air source is in communication with the fresh food compartment via a plenum, wherein the temperature dampening member has two ends comprising a first end located within the drawer and a second end located within the plenum, wherein the entire first end located within the drawer is in direct communication with the interior of the drawer, and the entire second end is in direct communication with the plenum to thereby create a dry freezing source, wherein heat is conducted away from the interior of the drawer through the temperature dampening member in communication with the freezing air source, and whereby freezing of a foodstuff within the drawer is minimized or prevented, a temperature variance within the drawer is minimized, and humidity within the drawer is not adversely affected by said dry freezing source.

2. The refrigerator of claim 1 wherein the drawer is slidably mounted with the fresh food compartment.

3. The refrigerator of claim 1 wherein the plenum is adjacent but entirely separated from the drawer.

4. The refrigerator of claim 1 wherein the temperature dampening member is made of a heat conducting material.

5. The refrigerator of claim 1 wherein the heat conducting material has a thermal conductivity of at least about 40 watts/meter-C°.

6. The refrigerator of claim 1 wherein the heat conducting material has a thermal conductivity in a range of about 40-600 watts/meter-C°.

7. The refrigerator of claim 1 wherein the heat conducting material is selected from the group consisting of aluminum, copper, steel, nickel, combinations thereof and alloys thereof.

8. The refrigerator of claim 1 wherein the temperature dampening member is planar member or a planar member with fins.

9. The refrigerator of claim 1 wherein the temperature dampening member is made entirely of a heat conducting material or partially of a heat conducting material.

10. The refrigerator of claim 9 wherein the temperature dampening member is partially made of strips of the heat conducting material, extending from end to end, within a matrix of a less conductive material.

11. The refrigerator of claim 10 wherein the less conductive material is synthetic plastic material.

12. A refrigerator comprises:

a temperature controlled and slidable drawer within a fresh food compartment including:

a temperature dampening member in thermal communication with a freezing air source delivered to the fresh food compartment via a plenum and an interior of the drawer, the member has two ends comprising a first end located within the drawer and a second end located within the plenum, the member is planar member or a planar member with fins, the member is made entirely of a heat conducting material or partially of a heat conducting material, and the thermally conductive material including aluminum, copper, steel, nickel, combinations thereof and alloys thereof, wherein the entire first end located within the drawer is in direct communication with the interior of the drawer, and the entire second end is in direct communication with the plenum to thereby create a dry freezing source, wherein heat is conducted away from the interior of the drawer through the temperature dampening member in communication with the freezing air source and whereby freezing of a foodstuff within the drawer is minimized or prevented, a temperature variance within the drawer is minimized, and humidity within the drawer is not adversely affected by said dry freezing air source.

* * * * *